United States Patent [19]

Nomura et al.

[11] 4,110,138

[45] Aug. 29, 1978

[54] HAND CRAFT YARN ART MATERIALS AND STRUCTURE AND METHODS OF MANUFACTURE AND USE THEREOF

[76] Inventors: Junichi Nomura, 10-4 Mitsuya-cho, Nagahama; Masashi Kanai, 1854-23, Ooka-machi, Yokohama, both of Japan

[21] Appl. No.: 778,676

[22] Filed: Mar. 17, 1977

[51] Int. Cl.[2] ..... B32B 5/08

[52] U.S. Cl. ..... 156/63; 156/72; 156/82; 156/251; 156/269; 156/497; 428/85; 428/89; 428/92; 428/95; 428/100; 428/542

[58] Field of Search ..... 156/63, 250, 253, 251, 156/82, 72, 497, 269; 428/92, 87, 89, 95, 100, 99, 542, 85; 26/9; 28/161

[56] References Cited

U.S. PATENT DOCUMENTS

| | | | |
|---|---|---|---|
| 3,285,797 | 11/1966 | Harrison et al. | 428/97 |
| 3,320,649 | 5/1967 | Naimer | 28/161 |
| 3,684,474 | 8/1972 | Chisholm | 28/161 |
| 3,695,987 | 10/1972 | Wisotzky et al. | 428/97 |
| 3,718,725 | 2/1973 | Hamano | 28/161 |
| 3,728,204 | 4/1973 | Cochran | 428/97 |
| 3,867,219 | 2/1975 | Bondi | 156/251 |
| 3,995,079 | 11/1976 | Haas | 428/87 |
| 4,015,036 | 3/1977 | Haemer | 156/251 |

*Primary Examiner*—William A. Powell
*Assistant Examiner*—Michael W. Ball

[57] ABSTRACT

A backing material for handcraft yarn arts comprises a foundation fabric having plural thermo plastic pile threads extending from one surface thereon in substantially upright direction with the free ends deformed by melting to assume enlarged, deformed configurations in a random and irregular pattern. Yarn of a generally soft or porous nature is placed in a desired pattern on the upstanding threads and loosely retained thereon while being readily removed to alter the pattern. When a final pattern is achieved, heat and pressure is applied, urging the yarn fully into and within the pile threads and further deforming the free ends into enlarged deformations for securely anchoring the yarn and providing a substantially permanent yarn part handcraft product.

21 Claims, 11 Drawing Figures

FIG. 5.
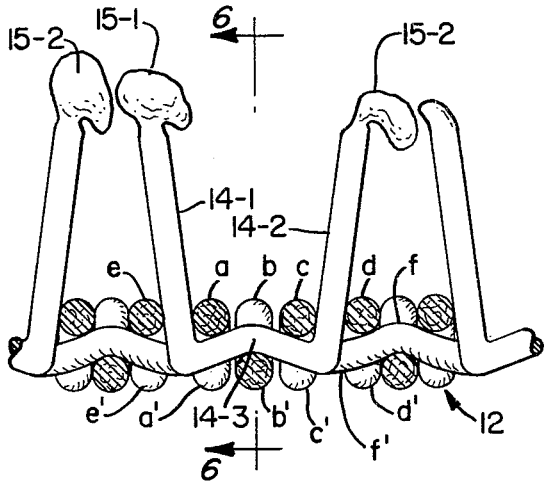
FIG. 6.
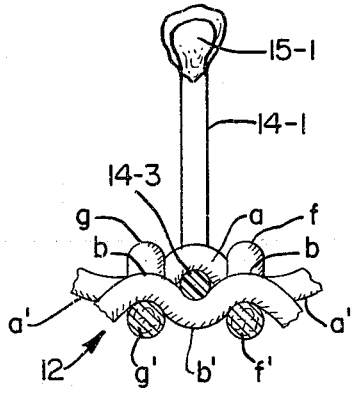
FIG. 7.
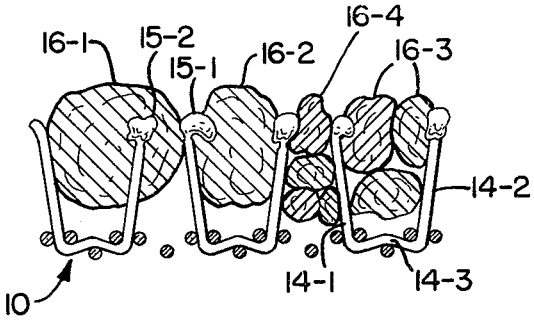
FIG. 8.
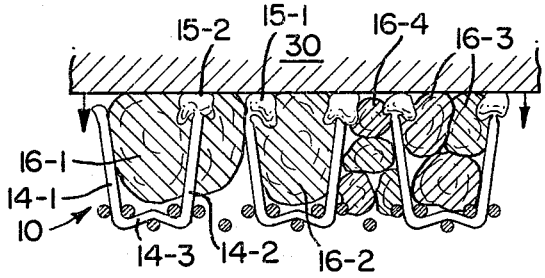
FIG. 9.
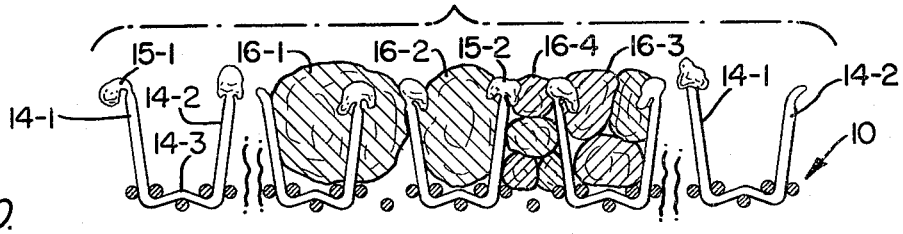
FIG. 10.
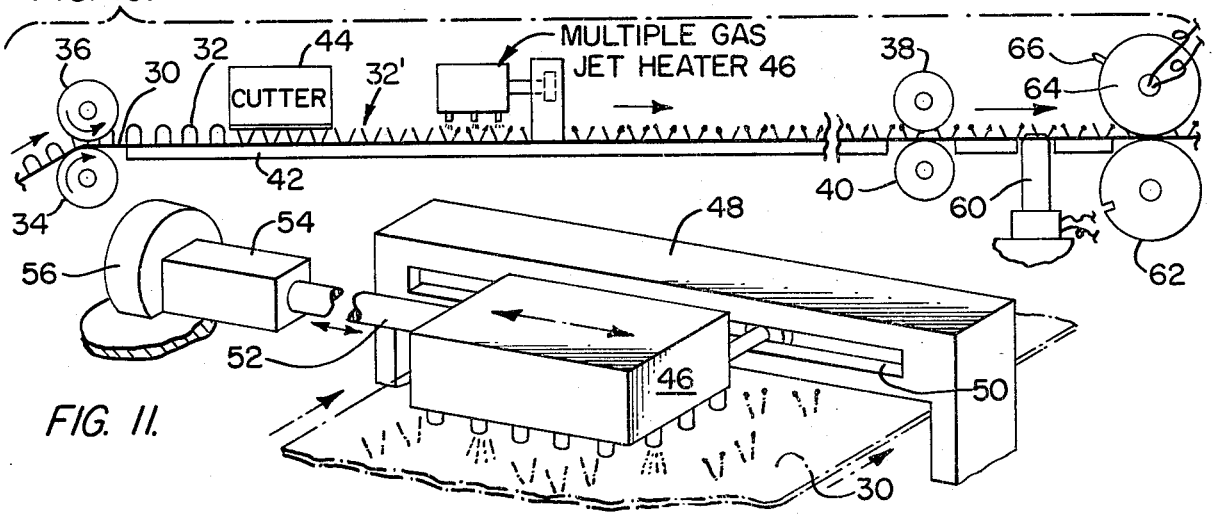
FIG. 11.

HAND CRAFT YARN ART MATERIALS AND STRUCTURE AND METHODS OF MANUFACTURE AND USE THEREOF

BACKGROUND OF THE INVENTION

1. Field of the Invention

This invention relates to handcraft materials and methods of manufacture and use thereof and, more particularly, to handcraft materials and such methods of manufacture and use for purposes of yarn art.

2. State of the Prior Art

As is known in the prior art, yarn may be employed for purposes of handcraft arts. Yarns of varying colors, textures and thicknesses are placed in desired patterns on a backing material or support. Such backing material or support preferably has a surface to which the yarn can adhere such that a desired pattern formed with the yarn is retained. Prior such surfaces have either had insufficient adherence characteristics to assure permanency of the resulting pattern of yarn or, conversely, have such extreme adherence, such as by use of adhesives or of mechanical hooking and interconnecting arrangements that the yarn, once deposited, cannot be removed even though a desired pattern is not achieved in a first attempt. Accordingly, the prior art has not provided a suitable backing material for use in handcraft yarn art.

SUMMARY OF THE INVENTION

In accordance with this invention, a backing material for handcraft yarn arts comprises a foundation fabric having plural thermo plastic pile threads extending from one surface thereof, each thread being anchored in at least a portion thereof in said foundation fabric and having a free end extending from said one surface of said one foundation fabric in a substantially upright direction, at least some of the free ends of the threads being deformed by melting to assume enlarged, deformed configurations in a random and irregular pattern relative to the cross-sectional dimension of the thread.

A variety of techniques for practicing yarn art are described in the Japanese patent application of the same present inventors, No. SHO 49-72845 filed June 27, 1974 and laid open to public inspection Jan. 8, 1976, No. SHO 51-1764. Related prior disclosures are contained in Japanese Utility Model applications of these same inventors, laid open to inspection as No. SHO 50-146887 and No. SHO 50-146649, both on Dec. 5, 1975 and in patent applications likewise of the same inventors Nos. SHO 49-101404 filed Sept. 5, 1974, laid open as SHO 51-32871 on Mar. 19, 1976 and SHO 49-132696 laid open as SHO 51-58575 on May 21, 1976.

The present invention relates to the basic techniques of those prior applications and provides a substantial improvement in the materials and processes involved, particularly as regards the formation and structure of the foundation fabric and the techniques of processing in practicing yarn art therewith.

A preferred process of manufacture includes weaving the thermo plastic pile threads in a deep pile, or loop configuration and thereafter cutting the protruding loop in the uppermost arcuate portion thereof to sever the loop into two portions and simultaneously form two free ends. The resulting threads thus are formed in pairs with a central portion common to each pair locked into the foundation fabric. Heat is applied, as by a plural gas jet unit driven in an irregular, reciprocating manner to irregularly heat and melt the free ends to form the irregular pattern of deformed globules on the free ends. In use for handcraft yarn art, yarn of a generally soft or porous nature is placed in a desired pattern onto the upstanding threads and urged gently into engagement therewith. The yarn is retained in place by the threads, but is readily removed therefrom to permit alternation of the yarn type or position, as desired. When a final pattern is achieved, heat and pressure is applied to the surface of the yard pattern to urge the yarn more fully into and within the upright, plastic pile threads and to further deform the free ends thereof into enlarged deformations serving to securely anchor the yarn to the pile threads and provide a substantially permanent yarn art handcraft product.

Accordingly, it is an object of this invention to provide an improved handcraft material for yarn art.

Another object of the invention is to provide yarn art handcraft materials which permit forming a substantially permanent yarn art product.

Still another object of the invention is to provide handcraft materials for yarn art including a backing material having sufficient adherence characteristics to permit retaining yarn in initial patterns presented thereon, yet in a releasable manner whereby the yarn may be removed and replaced with the same or different yarn in a new or different position until a desired pattern is achieved, after which the yarn art pattern may be substantially permanently affixed in the backing material.

Yet another object of the invention is to provide an improved process for making such handcraft backing material affording the above desired objects and advantages.

Still a further object of the invention is to provide an improved method of practice of handcraft yarn arts through use of the improved backing material of the invention, that material having a pile surface formed of plural thermo-plastic threads extending upwardly from one surface of a foundation fabric with an irregular, random pattern of slightly deformed and somewhat enlarged free ends thereon, the method of use being to dispose the yarn in desired patterns on the backing material with the thermo-plastic threads gently retaining same therewithin and yet permitting removal of the yarn until a final desired pattern is achieved, after which, heat and pressure is applied to the pattern to firmly embed the yarn within the threads and to further deform the free ends of the threads and enlarge same to securely lock the yarn therewithin, thereby rendering the pattern substantially permanently attached and adhered to the backing material.

BRIEF DESCRIPTION OF THE DRAWINGS

FIG. 5 is a cross-sectional view taken along the line 5—5 in FIG. 3;

FIG. 6 is a cross-sectional view taken along the line 6—6 in FIG. 5;

FIGS. 7, 8 and 9 are cross-sectional views of the backing material of the invention and illustrate successive steps in the practice of yarn art in accordance with this invention, initial placement of yarn of desired type and in a desired pattern on the backing material being shown in FIG. 7; the application of heat and pressure to the yarn pattern when a desired pattern has been achieved being shown in FIG. 8; and the resulting yarn art product being seen in FIG. 9;

FIG. 10 is a schematic view of a method of manufacture of the handcraft backing material of the inveniton; and FIG. 11 is a perspective schematic view of the heating unit employed in FIG. 10 and a related mechanical operating unit employed therewith.

DETAILED DESCRIPTION OF THE INVENTION

Figure 1:
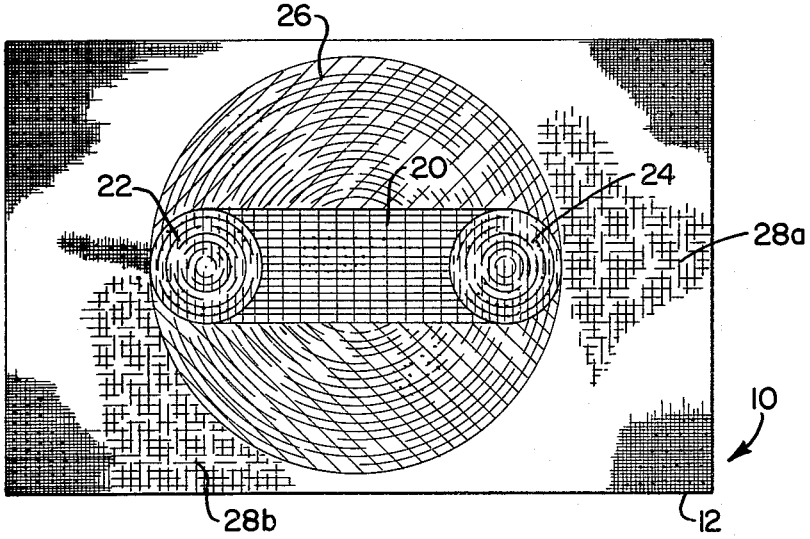
FIG. 1 is a top plan view of the handcraft backing material of the invention for practice of yarn art and having in a central portion thereof an illustrative yarn art pattern.
Figure 2:
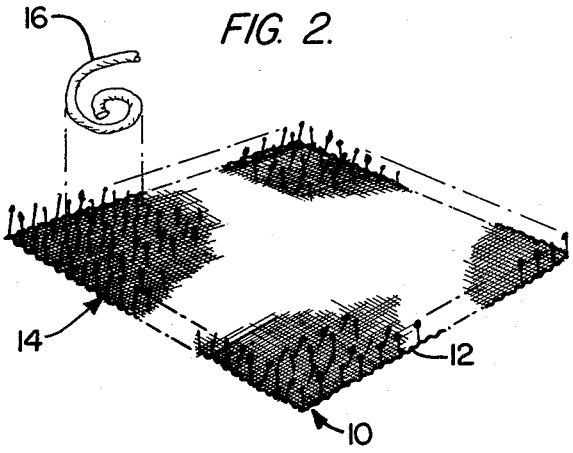
FIG. 2 is a perspective view on a greatly enlarged scale of the backing material shown in FIG. 1 with a broken-away portion of a segment of yarn of a desired configuration for being received and retained within the upright thermal plastic pile threads of the backing material.

The backing material 10 of the invention is shown in a top planar view in FIG. 1 and in a perspective, greatly enlarged view of a small section thereof in FIG. 2. With concurrent reference to FIGS. 1 and 2, the backing material 10 includes a foundation fabric 12. The fabric 12 may be of any desired material but preferably is woven and has somewhat porous characteristics for a reason to be explained. As best seen in FIG. 2, a plurality of substantially upright threads 14 extend in upright fashion from one surface of the foundation fabric 12, forming a pile surface. For convenience, the threads are described as extending in substantially upright fashion from the surface of the foundation fabric, for purposes of indicating the relative orientation of the threads and the fabric, without limiting the absolute orientation of either.

As shown in FIG. 2, several, but not necessarily all, of the upright threads are enlarged, or deformed, at the free ends thereof in an irregular, random pattern, the "free ends" being those ends remote from the surface of the foundation fabric 12. Preferably, the threads 14 depart from a right angle in at least one dimension to enhance the retaining or adhering characteristics thereof when yarn is placed on the backing material, in a manner as more fully explained hereinafter. As seen in FIG. 2, in the dimension from the lower right to the upper left, the threads are substantially vertical and in parallel rows, whereas in the dimension from the lower left to the upper right in FIG. 2, the threads are angled somewhat from the true vertical in an alternating, paired fashion.

FIG. 2 illustrates a spiral formation of a segment of yarn 16 in an exploded position relative to the backing material 10, it being understood that the yarn 16 is received loosely, or releasably, within the upright pile threads to maintain same in position in the process of creating the desired pattern of the yarn.

FIG. 1 shows a pattern of yarn formed on the backing material 10, for purposes of illustrating the use and versatility of the present invention. In the central portion of the material 10 there is provided an elongated pattern 20 extending from left to right and terminating in corresponding arcuate boundaries with the peripheries of circular, or spiral, patterns 22 at the left and 24 at the right, as seen in FIG. 1. Parallel yarn lengths form the pattern 20 and by the cross-hatching, illustratively, may be red in color. Rather than individual short lengths of yarn, a loop could be formed at the opposite ends to develop the pattern 20 from a single length of yarn. The patterns 22 and 24 may be formed from a continuous spiral of yarn, illustratively shown by cross-hatching to be purple in color in each case. The large circular pattern 26 may be formed of separate or looped lengths of yarn terminating at each instance at the boundary of the central portions 20, 22, and 24 and, as shown, may be brown in color. As will be explained hereafter, the material 10 has sufficient capacity, with due regard for the cross-sectional dimensions of the yarn employed, to permit extending yarn of one pattern in superposed relationship across the yarn of a different pattern region. It is believed apparent that numerous possibilities for achieving designs are present, using yarn of a variety of colors, thicknesses, and disposed in any of desired numbers of patterns in contiguous, superposed or spaced-apart relation in the backing material 10.

As earlier referenced, the backing material 10 preferably is porous and may have the general flexibility and characteristics of typical canvas fabric. Utilizing a somewhat porous medium for the foundation fabric 12 permits painting or otherwise coloring the fabric 12 itself, as shown illustratively in regions 28A and 28B, by conventional cross-sectioning, to be yellow in color. Very pleasing effects can be achieved by coloring the background material. The presence of the upright thermo-plastic pile threads in the colored areas, the thermoplastic threads not absorbing the coloring agent, creates a distinctive textured, or three-dimensional, effect.

Figure 3:
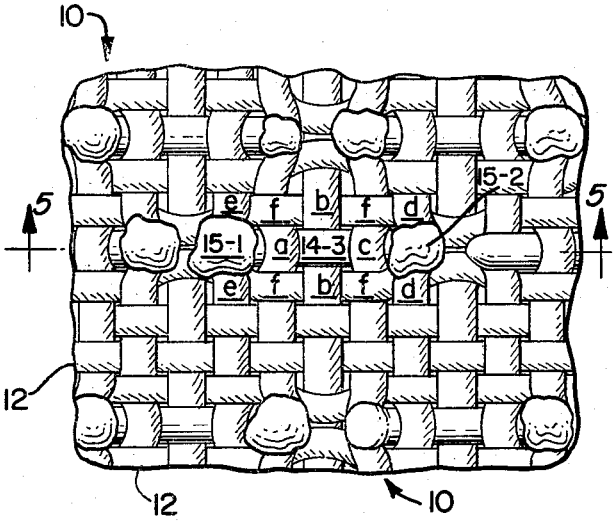
FIG. 3 is a top plan view on a greatly enlarged scale illustrating the backing material of woven nature and the free ends of thermal plastic pile threads extending substantially upwardly therefrom.
Figure 4:
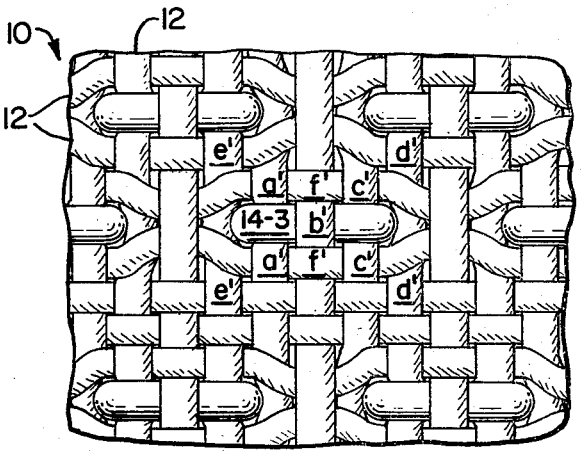
FIG. 4 is a bottom plan view of the handcraft backing material of FIG. 1, on a greatly enlarged scale.

FIGS. 3 and 4 are top and bottom plan views, respectively, of a small portion of the backing material 10, shown on a greatly enlarged scale relatively to FIG. 1 as well as to an actual backing material, to permit illustration of the woven foundation fabric and the interlocking of the thermo-plastic pile threads.

FIG. 5 is a cross-sectional view taken along the line 5—5 in FIG. 3 and FIG. 6 is a cross-sectional view taken along the line 6—6 in FIG. 5. To better illustrate the interlocking nature of the foundation fabric with respect to the upright thermo-plastic threads, all of FIGS. 3 through 6 are illustrated on a greatly enlarged scale. Referring first to FIG. 5, the upright thermo-plastic threads extend substantially in a paired relationship, one such pair being shown to comprise the individual threads 14-1 and 14-2 joined in a common central portion 14-3 interlocked within the foundation fabric 12. The woven nature of the fabric 12 is readily seen in these views. With concurrent reference to FIGS. 3 through 6 inclusive, selected threads of the fabric 12 have been labeled *a* through *g*, the unprimed letters corresponding to upper portions of those threads as best seen in the top plan view of FIG. 3 and the primed such letters corresponding to the lower travels of those threads resulting both from the weave of the fabric 12 and also their interlocking relationship with respect to the intermediate portion 14-3 of the pair of threads 14-1 and 14-2. As best seen in FIG. 5, each of the upright threads 14-1 and 14-2 is urged into a vertically upright position by the confining strands *a* and *e*, and the strands *c* and *d*, respectively, with the intermediate lower portion strand *b'* urging the central portion 14-3 upwardly to encourage that generally upright orientation. FIG. 6 as well emphasizes the interlock achieved between the upper portion strand *a* and the lower portion strand *b'* in turn interlocked by the adjacent, transverse weave strands *f* and *g* of the foundation fabric 12. It will be appreciated that strand *g* (*g'*) is removed in FIG. 5 for clarity of illustration.

FIGS. 5 and 6, moreover, illustrate the enlarged, irregular bulbous ends 15-1 and 15-2 of the respective upright threads 14-1 and 14-2. As will be explained shortly, the bulbous ends are not necessarily present on all of the threads but will be present on a fair proportion thereof. Moreover, it is to be understood that these bulbous ends are only slightly enlarged relatively to the diameter or cross section of the individual threads.

FIGS. 7, 8 and 9 illustrate successive stages in the use of the handcraft backing material 10 of the invention in forming yarn art products. As before noted, yarns of various sizes, colors and textures can be employed. For example, with concurrent reference to FIGS. 7 through 9, yarn 16-1 is of relatively large cross-sectional diameter, exceeding that of the spacing between adjacent upright thermo-plastic threads. Obvious relative dimensional relationships exist as to the further yarns 16-2, 16-3 and 16-4. Yarns of these different dimensions are readily accepted by the upstanding threads, such as by grouping of several smaller diameter yarns as shown at 16-4 or, recognizing the looseness or softness of most yarns, the thermo-plastic threads may extend directly through the body of the yarn as shown in 16-1. The bulbous ends of the threads serve to loosely engage and retain the yarn to facilitate developing a desired pattern. Nevertheless, the yarns may be removed without difficulty and without damage to the yarn itself. Likewise, contrary to prior art techniques employing adhesives the yarn may be removed without damage to it and without leaving a residue of yarn behind in an undesired location. Such prior art defects are fully avoided by the backing material of the invention.

FIG. 8 illustrates the next step of operation wherein a desired pattern has been achieved. Schematically shown at 30 is a sturcture for supplying heat and pressure to the pattern of yarn, thereby to fully embed the yarn within the thermal plastic threads and, moreover, the heat further deforming the free ends of the threads to produce enlarged deformations on those ends.

The final product now is shown in FIG. 9, the enlarged ends of the threads securely locking the yarns therewithin. The versatility of the backing material is well evidenced in this structure. The large yarn 16-1 is held in place both peripherally and interiorally by the pair of threads shown in association therewith. Likewise, the smallest yarns 16-4 are held in place by a wedging action, as are the yarns 16-2 and 16-3. The end product therefore achieves a substantially permanent nature; moreover, the natural resiliency of the yarn permits the same to expand above the surface of a majority of the free ends of the thermo-plastic threads to achieve a substantially continuous yarn surface in the final product.

FIG. 10 illustrates schematically a method of manufacture of the backing material of the invention. Typically, the thermo-plastic thread is woven simultaneously with the weaving of the foundation fabric with the result that the backing material as shown at 30 has a plurality of loops 32 of the thermo-plastic material extending from the surface thereof, each of those loops 32 being locked within the foundation fabric as seen in FIG. 5. The material 30 is held in taut condition over an idler roller 34 by a cooperating restraining roller 36 and driven by a pair of rollers 38, 40 one of which is driven and the other of which serves as a pincher roller, the material being supported therebetween on support 42.

As the material is advanced, the pile loops are cut by cutter 44 positioned a fixed distance above support 42 to form separated, up-standing threads, the tension in the thread caused by the loop configuration causing the loops to spring apart to a somewhat less than strictly vertical position, as illustrated at 32' and as has been commented in detail above with reference to FIG. 5.

The heating operation to produce the initial, irregular enlarged ends on the upstanding threads is performed by heater 46 which comprises preferably a multiple gas jet arrangement, better seen in conjunction with FIG. 11. FIG. 11 shows the same multiple gas jet heater 46 in perspective view to include plural rows and columns of jets which may form a regular or irregular pattern as desired. As seen in FIG. 11, the heater 46 is mounted to a support rail 48 for reciprocating motion along a track 50 thereof, the heater 46 being driven by shaft 52 from an eccentric 54 in turn driven by a motor 56. The eccentric 54 may provide irregular reciprocating movement of the heater 46, which movement, coupled with the regular or irregular pattern of gas jets of the heater 46 result in an irregular heating pattern being applied to the cut ends of the thermo-plastic piles 32'. The result is to form the irregular, random pattern of enlarged deformations on the ends of the upstanding threads, as have been illustrated hereinabove.

FIG. 10 also shows a heated blade 60, in profile, and of which there may be one or more, for severing the advancing sheet 30 into strips of desired widths. A cooperating roller 62 and a roller 64 then engage the severed strips to continue advancing the material. Roller 64 carries a heated blade 66 which serves to sever the plural strips into desired lengths. The use of heat in cutting the material serves to provide a finished edge strip around the periphery of each resulting piece of material thereby preventing any unravelling of the basic foundation fabric and, moreover, providing an essentially finished appearance and structure around the periphery, suitable for the intended use of this material in accordance with the invention.

As a further feature, a thermoplastic resin may be applied to the foundation fabric, either by spraying or dipping, especially as to the surface from which the pile threads extend, coating same and that corresponding surface of the foundation fabric. In use, the application of heat and pressure will soften the resin to further engage and severe the yarn pattern onto the foundation fabric.

Accordingly, the foregoing has disclosed a preferred embodiment of the method of manufacture of the backing material and of a resulting, improved backing material for use in practicing handcraft arts in accordance with this invention. Modification and adaptations of the invention will be apparent to those of skill in the art and thus it is intended by the appended claims to cover all such modifications and adaptations which fall within the true spirit and scope of the invention.

What is claimed is:

1. A backing material for handcraft yarn acts comprising:

a foundation fabric having a regular woven pattern of a first thread material including warps and woofs and having interwoven therewith a warp of thermo plastic pile threads interlocked by the warps and woofs, said thermo plastic pile warps being initially formed as elongated pile loops, said pile loops being cut in the upper arcuate portions thereof to form individual pile threads extending from said surface of said foundation fabric in substantially upright relation and having free ends, adjacent such individual threads having a common central portion remaining interlocked in the foundation fabric by the warps and woofs of said first material thereof, said individual pile threads being of a height relative to said foundation fabric corresponding to the same order of magnitude of the thickest diameter yarn to be applied to the backing material, and the free ends of said thermo plastic threads being deformed by application of heat thereto in an irregular random pattern to form an irregular random pattern of enlarged deformations on the ends thereof.

2. A backing material as recited in claim 1, wherein: said upright thermo plastic pile threads are displaced in a regular repeating pattern along the warp direction of the foundation fabric, and are displaced in alternate larger and smaller amounts with respect to the woof direction of the foundation fabric.

3. A backing material as recited in claim 1, wherein: said individual upright threads of each related pair thereof are spaced by a distance with respect to each other, and with respect to the individual threads of adjacent such pairs thereof to accommodate and receive in loose engagement therewith yarn to be applied thereto in accordance with the said handcraft yarn art.

4. A backing material as recited in claim 3 wherein said spacing between said upright threads of each related pair is greater than the spacing between the upright threads in the warp direction of said foundation fabric.

5. A backing material as recited in claim 1 wherein the thermo plastic upright threads are spaced in the woof direction of the foundation fabric in alternate larger and smaller amounts defined by respective larger and smaller numbers of warp dimensions of the foundation fabric, said larger and smaller amounts being selected in accordance with cross-sectional diameters of yarn to be received thereby in accordance with the practice of said handcraft yarn arts and the larger amounts being not greater than several cross-sectional diameters of the smallest cross-sectional diameter yarns to be applied and the smaller amounts being not substantially less than the cross-sectional diameter of the largest yarn to be applied thereto.

6. A backing material for handcraft yarn arts comprising:

a foundation fabric formed of a first material and having woven therewithin and extending from one surface thereof a plurality of thermo plastic pile threads, each such thread having a free end remote from the said surface of said foundation fabric, said individual pile threads being of a height relative to said foundation fabric corresponding to the same order of magnitude of the thickest diameter yarn to be applied to the backing material, and the free ends of at least some of the thermo plastic threads having enlarged ends thereon formed by melting from the application of heat thereto, in an irregular, random pattern.

7. A backing material is recited in claim 6 wherein said thermo plastic pile threads extend from said one surface of said foundation fabric in predetermined, spaced direction relatively to each other to define therebetween interstices for receiving yarn thereon, the interstices being not substantially less than the largest cross-sectional diameter of yarn to be received and not substantially greater than the sum of several cross-sectional diameters of yarn to be received thereon.

8. A backing material as recited in claim 7 wherein said thermo plastic pile threads are responsive to the application of heat and pressure thereto for achieving further deformation of substantially all the free ends thereof at least in those portions of the material in which yarn has been applied in accordance with said handcraft yarn arts, said further, enlarged deformation of said free ends interlocking said yarn with said thermo plastic pile threads to securely retain same therewithin.

9. The backing material as recited in claim 6, further comprising a thermo plastic resin applied to said one surface thereof.

10. A handcraft yarn art product comprising:

a backing material comprising a foundation fabric formed of a first material and having woven therewithin and extending from one surface thereof a plurality of thermo plastic pile threads, each such thread having a free end remote from the said surface of said foundation fabric, the free ends of at least some of the thermo plastic threads having enlarged ends thereon formed by melting from the application of heat thereto in an irregular, random pattern, yarn of a relatively porous nature applied to said surface of said backing material and held therewithin loosely by the irregular enlarged ends of said thermo plastic pile threads, and said backing material containing yarn applied thereto and loosely secured thereon by said enlarged ends of said threads being responsive to the application of heat and pressure at least in the areas thereof on which said yarn is received for further deformation of said irregular enlarged ends, to fully receive said yarn thereon and to further deform the ends of said thermo plastic piles into more greatly enlarged deformations extending within and interlocking the yarn structure onto the backing material.

11. A handcraft yarn as recited in claim 10 wherein the said first material of said foundation fabric is porous for receiving and retaining therein coloring material, and said thermo plastic materials are non-porous so as not to be affected by coloring material retained in said foundation fabric.

12. The backing material as recited in claim 10, further comprising a thermo plastic resin applied to said one surface thereof.

13. A method of manufacture of a backing material for handcraft yarn arts from a foundation fabric having plural thermo plastic pile loops anchored within the foundation fabric and extending from one surface thereof in substantially upright relation with respect thereto, the loops having respective arcuate portions displaced from said one surface of the foundation fabric at substantially equal height of the order of magnitude of the thickest diameter yarn to be applied to the backing material, comprising:

cutting the loops to form separate threads having individual free ends of the said order of magnitude in height, the threads remaining in substantially upright relation extending from said one surface of said foundation fabric by virtue of the rigidity of the thermo plastic pile thread material, applying heat in an irregular pattern to the free ends of the said upright threads of the material to produce an irregular, random pattern of enlarged ends of said threads resulting from deformation of the thread material due to the heat.

14. A method as recited in claim 1 further comprising severing the backing material having the randomly deformed upright threads thereon into individual pieces thereof of desired size by use of heated cutting elements, regulating the heat of the cutting elements to substantially melt the thermo plastic pile threads engaged by the cutting elements without damaging the foundation fabric, thereby to provide a finished cut edge about the periphery of the individual pieces.

15. A method as recited in claim 1 wherein the irregular heating is performed by applying a plurality of gas jets to the free ends of the upright threads, and effecting relative movement between the gas jets and the fabric so as to provide an irregular heating pattern for producing the irregular deformation of the free ends.

16. A method as recited in claim 15, further comprising moving the foundation fabric in a continuous path in a first direction, cutting the pile threads to form the individual threads having free ends in a first operation at a first position relative to the said direction of movement of said fabric, applying heat by means of plural gas jets directed to the free ends of said upright threads at a second position along said direction of movement, and displacing said gas jets in a reciprocating manner transversely to said direction of movement to provide said irregular heating pattern.

17. A method as recited in claim 1, further comprising performing said cutting operation at a third position displaced along said direction of movement.

18. A method as recited in claim 1, further comprising applying a thermo plastic resin to said material at said one surface thereof.

19. A method of practicing handcraft yarn arts utilizing a backing material comprising a foundation fabric having plural thermo plastic pile threads extending from one surface thereof with the free ends of the pile threads remote from said foundation fabric being deformed in an irregular, random pattern, comprising applying yarn to said backing material of desired colors and amounts and in desired patterns, the irregular deformed ends of said upstanding thermo plastic pile threads loosely securing the applied yarn to the backing material in a releasable manner to permit removal and replacement of the yarn on the backing material at will, and when a desired pattern of yarn is established on a backing material, applying heat and pressure to at least the areas of said backing material containing said pattern of yarn thereby to firmly depress said yarn onto the foundation fabric and to further deform the free ends of said thermo plastic pile threads in response to the heat and pressure thereby to interengage with the yarn and securely anchor the yarn to the backing material.

20. A method as recited in claim 19 wherein the foundation fabric is formed of a material receptive to coloring agents and said thermo plastic pile threads are not receptive to such coloring agents so as to not to retain same, further comprising applying a coloring agent to the foundation fabric thereby to color same in desired areas to provide a handcraft yarn art product including patterns both of yarn and colored foundation fabric.

21. A method as recited in claim 19 wherein said formation fabric has a thermo plastic resin on said one surface thereof, and wherein said application of heat causes said thermo plastic resin to soften and engage said yarn, further to secure said yarn to said foundation fabric.

* * * * *

UNITED STATES PATENT AND TRADEMARK OFFICE

CERTIFICATE OF CORRECTION

PATENT NO. : 4,110,138
DATED : August 29, 1978
INVENTOR(S) : Junichi Nomura et al It is certified that error appears in the above-identified patent and that said Letters Patent are hereby corrected as shown below:

On the title page, above the Abstract insert

--Attorney, Agent, or Firm—Staas & Halsey --

Col. 5, line 40, "sturcture" should be -- structure --.

*Col. 6, line 45, "thermoplastic" should be -- thermo-plastic --.

*Col. 6, line 51, "severe" should be -- sever --.

*Col. 10, line 32, delete "to" (second occurrence).

Signed and Sealed this

First Day of May 1979

[SEAL]

Attest:

RUTH C. MASON
Attesting Officer

DONALD W. BANNER
Commissioner of Patents and Trademarks